US005777252A

United States Patent [19]

Tada

[11] Patent Number: 5,777,252

[45] Date of Patent: Jul. 7, 1998

[54] ATMOSPHERE DATA GENERATOR AND KARAOKE MACHINE

[75] Inventor: Yukio Tada, Hamamatsu, Japan

[73] Assignee: Yamaha Corporation, Hamamatsu, Japan

[21] Appl. No.: 787,437

[22] Filed: Jan. 22, 1997

[51] Int. Cl.[6] ..... A63H 5/00; G04B 13/00; G10H 7/00

[52] U.S. Cl. ..... 84/609; 434/307 A

[58] Field of Search ..... 84/609, 610, 634, 84/600, 601; 395/956

[56] References Cited

U.S. PATENT DOCUMENTS 5,056,021 10/1991 Ausborn .
5,233,438 8/1993 Funahashi et al. .
5,250,747 10/1993 Tsumura ..... 434/307 A
5,262,765 11/1993 Tsumura et al. .

*Primary Examiner*—William M. Shoop, Jr.
*Assistant Examiner*—Jeffrey W. Donels
*Attorney, Agent, or Firm*—Loeb & Loeb LLP

[57] ABSTRACT

A CPU (10) reads coordinate data within an emotional expression data base (25) in accordance with lyrics data within a RAM. The CPU (10) also sequentially reads performance data and generates a parameter (VP) corresponding to the volume of a piece of music and a parameter (CP) corresponding to the chord of the piece of music. The parameter (VP) adjusts the position on an emotional plane in a Y-axis direction, and the parameter (CP) adjusts the position on the emotional plane in an X-axis direction. The CPU (10) corrects the coordinates outputted from the emotional expression data base (25) based on the parameter (VP) and the parameter (CP). Therefore, the final coordinates on the emotional plane are those obtained by correcting the coordinates corresponding to the lyrics data in accordance with the volume and chord.

6 Claims, 3 Drawing Sheets

ATMOSPHERE DATA GENERATOR AND KARAOKE MACHINE

BACKGROUND OF THE INVENTION

Field of the Invention

This invention relates to an atmosphere data generator and a karaoke machine that generate atmosphere data based on performance data for karaoke (singing to recorded orchestral accompaniment) and lyrics data.

Background

In a so-called karaoke machine, when a user selects a desired song, an orchestral accompaniment for such song is played, and further, a background image and the lyrics of such song are displayed on a monitor. In such operation, the characters indicating the lyrics of the song are displayed in different colors so as to match the progress of the song so that the progress of the song can be recognized visually.

This operation, which has heretofore been performed by reproducing a video signal using an optical disk in a simple way, is sometimes performed through telecommunication in recent years. For example, a karaoke machine of a host station is connected to that of a terminal station through a telephone network or the like, and the host station transfers performance data of a song selected at the terminal station and causes the terminal station to store such performance data in a storage section of the terminal station (hard disk or the like). Then, the terminal station generates accompaniment sounds based on the performance data read from the storage section thereof, and further, displays the lyrics in different colors in accordance with the progress of the accompaniment. Further, in this case, a background image (video image) is reproduced so as to be superimposed on the lyrics by reading from an optical disk background data corresponding to a genre to which the selected song belongs.

The conventional karaoke machine displays a background corresponding to the image of a song and its lyrics, however, the conventional karaoke machine does not reflect changes corresponding to minutely changing melodies and lyrics, lacking in the climax of an atmosphere. In addition, if special effects (such as an acoustic effect produced through a microphone and illumination) corresponding to the music and lyrics of the song can be provided, it is more desirable. However, there has been no karaoke machine that can provide such effects in the past.

Further, in an automatically playing piano and automatic performance apparatus that provide automatic performance based on performance data (generally MIDI data), there is no such piano and apparatus that can provide a display and special effects corresponding to minutely changing melodies, again lacking in climax.

SUMMARY OF THE INVENTION

The present invention has been made in view of the aforementioned circumstances. The object of the invention is to provide an atmosphere data generator that can extract an atmosphere from the melody and lyrics of a song and outputs the extracted atmosphere as data, and a karaoke machine.

The foregoing object of the invention have been achieved by an atmosphere data generator that includes: a word emotion data storage device for storing word emotion data indicating the attribute of an emotion with respect to a predetermined plurality of words; a word data storage device for storing word data indicating a word; a reading device for sequentially reading the words stored in the word data storage device; a word emotion data searching device for reading word emotion data corresponding to a word when the word read by the reading device coincides with the word stored in the word emotion data storage device; and an atmosphere data generating device for generating atmosphere data based on the word emotion data read by the word emotion data searching device.

Further, the foregoing object of the invention have been achieved by an atmosphere data generator that includes: a music data storage device for storing performance data corresponding to lyrics data of a piece of music and music data of the piece of music; a word emotion data storage device for storing word emotion data indicating the attribute of an emotion with respect to a predetermined plurality of words; a lyrics data reading device for reading lyrics data in accordance with a progress of the piece of music from the music data storage device; a word emotion data searching device for reading word emotion data corresponding to words when a lyrics read by the reading device coincides with the words stored in the word emotion data storage device; a performance data reading device for reading performance data in accordance with a progress of the piece of music from the music data storage device; a performance emotion data generating device for generating performance emotion data indicating the attribute of an emotion in accordance with a predetermined algorithm with respect to performance data read by the performance data reading device; and an atmosphere data generating device for generating atmosphere data based on the word emotion data read by the word emotion data searching device and the performance emotion data generated by the performance emotion data generating device.

Further, the foregoing object of the invention have been achieved by a karaoke machine that includes: a music data storage device for storing performance data corresponding to lyrics data of a piece of music and music data of the piece of music; a word emotion data storage device for storing word emotion data indicating the attribute of an emotion with respect to a predetermined plurality of words; a lyrics data reading device for reading lyrics data in accordance with a progress of the piece of music from the music data storage device; a word emotion data searching device for reading word emotion data corresponding to words when a lyrics read by the reading devive coincides with the words stored in the word emotion data storage device; a performance data reading device for reading performance data in accordance with a progress of the piece of music from the music data storage device; a performance emotion data generating device for generating performance emotion data indicating the attribute of an emotion in accordance with a predetermined algorithm with respect to performance data read by the performance data reading device; an atmosphere data generating device for generating atmosphere data based on the word emotion data read by the word emotion data searching device and the performance emotion data generated by the performance emotion data generating device; an accompaniment device for providing an accompaniment based on the performance data read by the performance data reading device; a lyrics displaying device for displaying characters corresponding to the lyrics data read by the lyrics data reading device; and a displaying device for providing a display corresponding to the atmosphere data generated by the atmosphere data generating device.

DETAILED DESCRIPTION OF THE PREFERRED EMBODIMENTS

1. General Configuration

Figure 1:
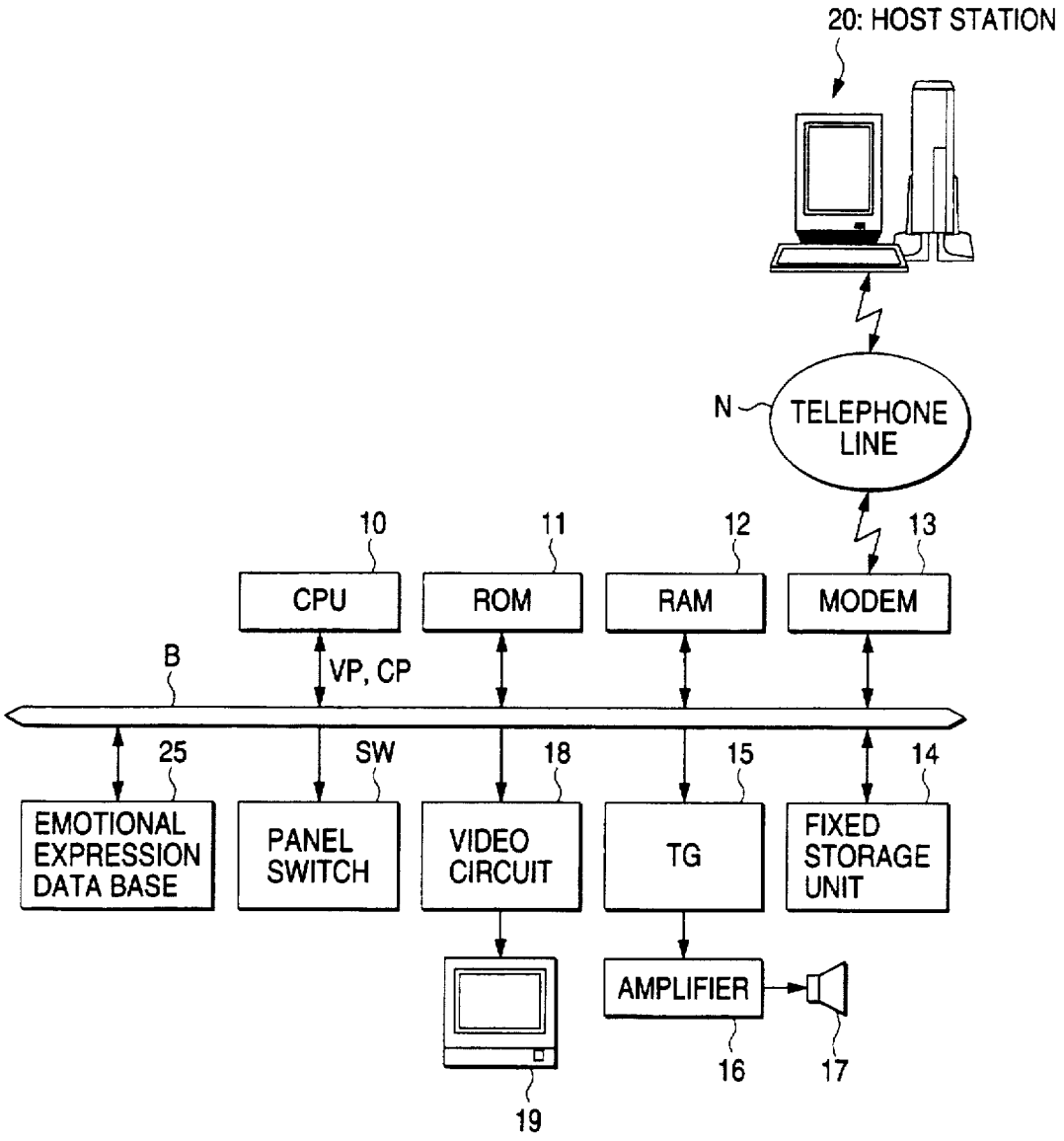
FIG. 1 is a block diagram showing a configuration of a karaoke machine with a display, which is an embodiment of the invention.

An embodiment of the invention will now be described with reference to the drawings. FIG. 1 is a block diagram showing a configuration of a karaoke machine, which is an embodiment of the invention.

In FIG. 1, reference numeral 10 denotes a CPU that controls components that are connected thereto through a bus B; reference numeral 11 denotes a ROM that stores a basic program used in the CPU 10; reference numeral 12 denotes a RAM that temporarily stores data and the like used for controlling the CPU 10.

Reference numeral 13 denotes a modem that is arranged to transmit and receive data with a host station 20 through a telephone line N; reference numeral 14 denotes a fixed storage unit that includes a HDD (hard disk drive) or the like and stores music data sent from the host station 20, a main program used by the CPU 10, and the like. In this case, the music data includes performance data specifying the performance of each of musical instruments, lyrics data indicating the lyrics of a song, and color change timing data indicating a color change timing for lyrics.

Reference numeral 15 denotes a tone generator (TG) that synthesizes a musical tone based on the performance data out of the music data; and reference numeral 16 denotes an amplifier that amplifies a musical tone signal synthesized by the tone generator 15 and produces a sound towards outside space through a speaker 17.

Reference numeral 18 denotes a video circuit including a digital signal processor (DSP), a V-RAM (video-RAM), and a RAMDAC. The DSP interprets data that is chronologically supplied by CPU 10, and such interpretation is written in the V-RAM that corresponds to a display area. At the same time, such written interpretation is read in synchronism with the scanning frequency of a monitor 19, converted into an analog signal (video signal) by the RAMDAC, and supplied to the monitor 19. In accordance with these operations, the monitor 19 provides a display corresponding to the data written in the V-RAM.

Further, reference character SW denotes a panel switch that includes a switch through which the user selects a desired piece of music and operating buttons through which the user specifies a volume or musical scale. The panel switch SW provides the specified data to the CPU 10.

In this embodiment, the facial expression of an imaginary person made up of polygons is displayed on the monitor 19, and the facial expression of such person is controlled in accordance with the progress of the music or lyrics. Thus, data related to each polygon is stored in the fixed storage unit 14 as object data.

Such object data includes polygon shape data, polygon rule data, and joint data so as to correspond to various parts of the person. The "polygon shape data" means data defining the shape of each polygon expressing each part of the person. The "polygon rule data" means data defining depicting conditions, when each polygon is to be depicted. The "joint data" means data indicating conditions for jointing polygons. By using these data, the facial expression of a person can be depicted stereoscopically as well as dynamically.

Figure 2:
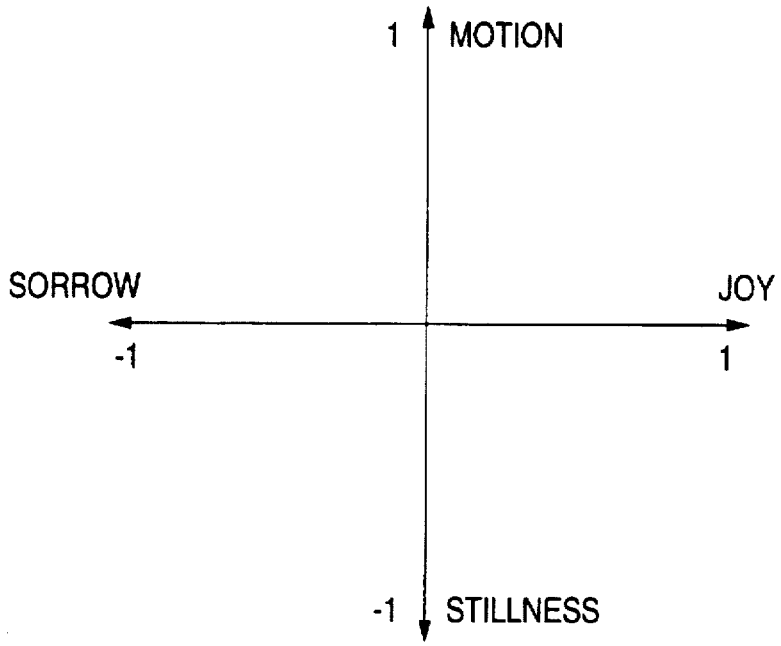
FIG. 2 is a diagram showing an emotional plane used in the embodiment shown in FIG. 1.
Figure 3:
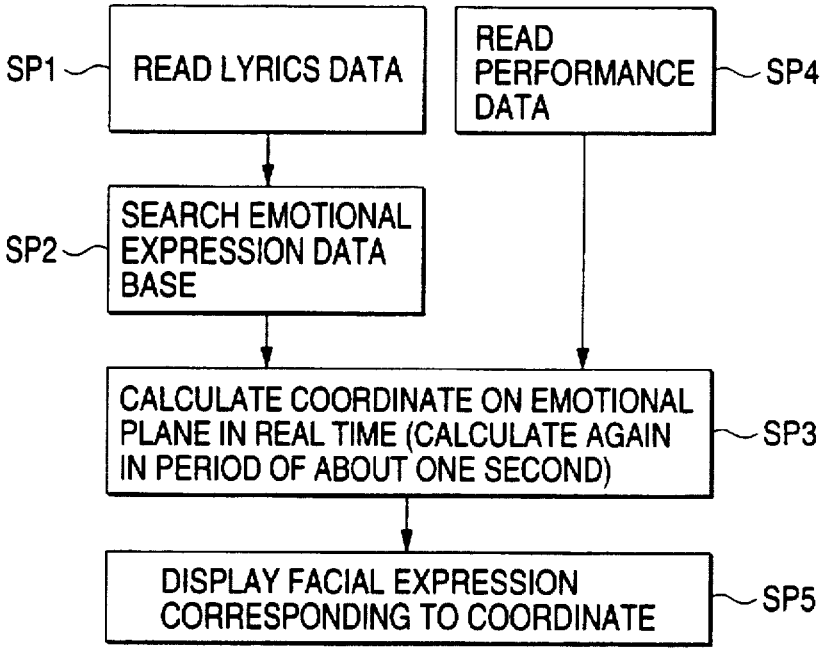
FIG. 3 is a flowchart showing an operation of the embodiment shown in FIG. 1.

Then, an emotional expression data base 25 stores a great number of predetermined words and coordinates on an emotional plane corresponding to the predetermined words. Let the emotional plane be described with reference to FIG. 2. As shown in FIG. 2, the emotional plane is such that the axis of abscissa indicates the degree of sorrow and joy and the axis of ordinate indicates the degree of stillness and motion. In this embodiment, the axis of abscissa is scaled in such a manner that the most pleasant is set to "1"; the saddest is set to "−1", and the axis of ordinate is scaled in such a manner that the greatest motion is set to "1" and the stillest is set to "−1".

The emotional expression data base 25 stores coordinates (1, 0) for a word, e.g., "pleasant", coordinates (0.9, 0.5) for a word "bright", coordinates (0, −0.7) for a word "sleep", and coordinates (0.2, 0.6) for a word "morning". That is, the emotional expression data base 25 stores coordinates on the emotional plane for predetermined words.

2. Operation

Then, the operation of the embodiment will be described. First, when a user, who will be a singer, selects a desired piece of karaoke music by operating the panel switch SW, the CPU 10 searches and reads the performance data of the piece of music and lyrics data from the fixed storage unit 14 and loads the read data to the RAM 12. Then, the CPU 10 sequentially reads the performance data and the lyrics data as the music progresses. As a result of this operation, the tone generator circuit 15 provides an instrumental accompaniment based on the read performance data. At the same time, the DSP within the video circuit 18 writes lyrics font data corresponding to the read lyrics data to the V-RAM, and updates the color of the characters for writing the lyrics so as to match the progress of the music.

Further, the CPU 10 checks whether the same words as those used in the lyrics data that has been read from the RAM 12, are stored in the emotional expression data base 25 or not. If the same words have been found, the coordinate data are read. Further, when the performance data within the RAM 12 is read, the CPU 10 generates a parameter VP corresponding to the volume of the music and a parameter CP corresponding to the chord of the music. By "parameter VP" it is intended to mean a parameter for adjusting the position of the emotional plane in a Y-axis direction, and the more the volume becomes large, the more the values become large. In this case, the values of the parameter VP may be determined based on the volume of a predetermined track such as, e.g., the melody track out of the performance data, or may be determined based on the statistics or averages of the volume data of a plurality of tracks.

On the other hand, by "parameter CP" it is intended to mean a parameter for adjusting the position of the emotional plane in a X-axis direction. The more the number of major chords increases within a predetermined time interval, the more the values become large. In this case, the values of the parameter CP are determined by checking the chords indicated by, e.g., the chord accompaniment track out of the performance data for a predetermined time interval. This time interval, for instance, may be specified as a measure having a predetermined length including musical notes being currently played. For example, it may be specified such as one measure or two measures including the musical notes.

Further, a chord may be detected by some other source than the chord accompaniment track. For example, a chord may be detected out of a change in a melody of the melody track, for example, or may be detected out of a combination of tones in the melody track and the other accompaniment track.

As described above, the CPU 10 detects the parameter VP and the parameter CP and corrects the coordinates outputted from the emotional expression data base 25 based on the parameter VP and the parameter CP. Therefore, the final coordinates on the emotional plane are those obtained by correcting the coordinates corresponding to the lyrics data in accordance with the volume and the chord.

The coordinates corresponding to the lyrics which is an emotional expression by characters and to the volume and chord which are an emotional expression by music are calculated by the CPU 10. The calculated values change in accordance with minutely changing lyrics, volume, and chord and are translated into values corresponding to an atmosphere at a current timing.

On the other hand, the video circuit 18 reads polygon data corresponding to the coordinates on the emotional plane calculated by the CPU 10 from the fixed storage unit 14, and prepares a facial expression of a person, and writes the prepared data in the V-RAM.

The video circuit 18 synthesizes the lyrics, the video signal serving to form a background image, and the facial image made of polygons written in the V-RAM with one another, and outputs a synthesized signal to the monitor 19. In response thereto, the monitor 19 displays the facial image synthesized by the background image, the lyrics, and the polygons.

Figure 4A:
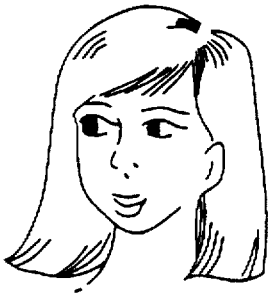
FIGS. 4*a* and 4*b* show exemplary displays in the embodiment shown in FIG. 1.
Figure 4B:
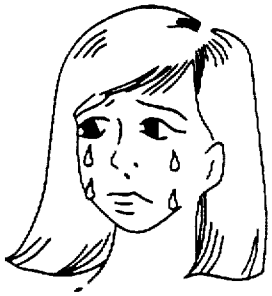

Since the facial image changes in a variety of ways in accordance with the atmosphere of a song, the singer can recognize correctly a change in atmosphere of the song out of the facial expressions indicated by the image. Therefore, the singer can check how the song should be sung and how he or she should express his or her feelings in which part of the lyrics and the music. FIGS. 4*a* and 4*b* show exemplary facial expressions displayed on the monitor 19. FIG. 4*a* shows one example of an facial expression in the case where the coordinates on the emotional plane are found in a region featuring motion and joy, and FIG. 4*b* shows one example of an facial expression in the case where the coordinates on the emotional plane are found in a region featuring stillness and sorrow.

3Modified Embodiment (1) The application of the invention is not limited to telecommunicating karaoke machines. For example, the invention may be applied to automatic performance apparatuses using MIDI performance data. The invention can also be applied to apparatuses that sequentially read and display data indicating words, and produce sounds of such data. In this case, coordinates on the emotional plane are detected by using only the word indicating data since there is no performance data.

(2) Further, control over facial expression is not limited to polygons but may be effected with a simpler way. For example, a plurality of facial expressions are stored in the form of dot map data and a facial expression corresponding to an atmosphere (i.e., a facial expression corresponding to the output values, the parameters VP, CP of the emotional expression data base 25) may be selected and displayed appropriately.

(3) Control is not limited to facial expression, but may be effected over other image. Further, display colors (background colors and the like) may be controlled. For example, it may be so controlled that a bright color is selected for a pleasant atmosphere and a dark color for a sad atmosphere.

(4) The invention is also applicable not only to the control of images but also to the control of acoustic effects produced through a microphone (echoing or filtering) or to the control of illumination of a karaoke room.

(5) While an atmosphere extracted from the lyrics data is adjusted by the performance data in the aforementioned embodiment, the atmosphere may be extracted only from the lyrics data. Conversely, the atmosphere may be extracted based only on the performance data. In short, an algorithm for extracting an atmosphere using factors such as chord, change in melody, change in tempo, change of musical instrument, and the presence or absence of chorus is determined in advance, and atmosphere extraction can be processed based on such algorithm.

Further, it may be so designed that atmosphere data may be prepared by detecting coordinates on the emotional plane from the performance data and by using both the detected coordinate data and coordinates obtained from the lyrics data (e.g., using an average).

Here, the elements of the invention defined for the case where an atmosphere is extracted only from the performance data are as follows.

"An atmosphere data generator, includes:

a performance data storage device for storing a performance data corresponding to a piece of music;

a performance data reading device for reading the performance data in accordance with progress of the piece of music from the performance data storage device;

a performance emotion data generating device for generating performance emotion data indicating the attribute of an emotion in accordance with a predetermined algorithm for the performance data read by the performance data reading device; and an atmosphere data generating device for generating atmosphere data based on the performance emotion data generated by the performance emotion data generating device".

(6) The emotional plane shown in FIG. 2 is merely an example; other plane and space can be used. It is important that a plane or space from which coordinates corresponding to an atmosphere be obtained using data reflecting such atmosphere.

(7) The control section related to the emotion plane in the aforementioned embodiment can be conceptually expressed in the following way.

"The atmosphere data generator in which the word emotion data storage device stores the word emotion data as coordinates on a predetermined plane indicating the attribute of an emotion; and the performance emotion data generating device generates the performance emotion data as correction values of the word emotion data."

Further, the control section related to the image display in the aforementioned embodiment can be conceptually expressed in the following way.

"The atmosphere data generator, further includes:

an image storage device for storing a plurality of images corresponding to atmosphere data;

a display device for providing a display corresponding to the image data supplied; and a display control device for reading from the image storage device an image corresponding to the atmosphere data generated by the atmosphere data generating device and supplying the read image to the display device."

As described in the foregoing, according to the invention, an atmosphere is extracted out of the content of a word (e.g., lyrics) or a melody and the extracted atmosphere can be outputted as data. Therefore, effects corresponding to the atmosphere can be given by controlling the data in a variety of ways.

Further, in a karaoke machine to which the invention is applied an atmosphere can be detected in accordance with a lyrics or a melody, and further, a display is provided in accordance with the atmosphere. Therefore, a singer can recognize a climax of the music for improving his or her vocalism.

What is claimed is:

1. An atmosphere data generator, comprising:

word emotion data storage means for storing word emotion data indicating the attribute of an emotion with respect to a predetermined plurality of words;

word data storage means for storing word data indicating a word;

reading means for sequentially reading the words stored in the word data storage means;

word emotion data searching means for reading word emotion data corresponding to a word when the word read by the reading means coincides with the word stored in the word emotion data storage means; and atmosphere data generating means for generating atmosphere data based on the word emotion data read by the word emotion data searching means.

2. The atmosphere data generator of claim 1, further comprising:

image storage means for storing a plurality of images corresponding to the atmosphere data;

display means for providing a display corresponding to the image data supplied; and display control means for reading from the image storage means an image corresponding to the atmosphere data generated by the atmosphere data generating means and supplying the read image to the display means.

3. An atmosphere data generator, comprising:

music data storage means for storing performance data corresponding to lyrics data indicating lyrics of a piece of music and music data of the piece of music;

word emotion data storage means for storing word emotion data indicating the attribute of an emotion with respect to a predetermined plurality of words;

lyrics data reading means for reading lyrics data in accordance with a progress of the piece of music from the music data storage means;

word emotion data searching means, when a lyrics read by the reading means coincides with words stored in the word emotion data storage means, for reading word emotion data corresponding to the words from the word emotion data storage means;

performance data reading means for reading performance data in accordance with a progress of the piece of music from the music data storage means;

performance emotion data generating means for generating performance emotion data indicating the attribute of an emotion in accordance with a predetermined algorithm with respect to performance data read by the performance data reading means; and atmosphere data generating means for generating atmosphere data based on the word emotion data read by the word emotion data searching means and the performance emotion data generated by the performance emotion data generating means.

4. The atmosphere data generator of claim 3, wherein the word emotion data storage means stores the word emotion data as coordinates on a predetermined plane indicating the attribute of an emotion, and the performance emotion data generating means generates the performance emotion data as correction values of the word emotion data.

5. The atmosphere data generator of claim 3, further comprising:

image storage means for storing a plurality of images corresponding to the atmosphere data;

display means for providing a display corresponding to the image data supplied; and display control means for reading from the image storage means an image corresponding to the atmosphere data generated by the atmosphere data generating means and supplying the read image to the display means.

6. A karaoke machine, comprising:

music data storage means for storing performance data corresponding to lyrics data indicating lyrics of a piece of music and music data of the piece of music;

word emotion data storage means for storing word emotion data indicating the attribute of an emotion with respect to a predetermined plurality of words;

lyrics data reading means for reading lyrics data in accordance with a progress of the piece of music from the music data storage means;

word emotion data searching means, when a lyrics read by the reading means coincides with words stored in the word emotion data storage means, for reading word emotion data corresponding to the words from the word emotion data storage means;

performance data reading means for reading performance data in accordance with a progress of the piece of music from the music data storage means;

performance emotion data generating means for generating performance emotion data indicating the attribute of an emotion in accordance with a predetermined algorithm with respect to performance data read by the performance data reading means;

atmosphere data generating means for generating atmosphere data based on the word emotion data read by the word emotion data searching means and the performance emotion data generated by the performance emotion data generating means;

accompaniment means for providing an accompaniment based on the performance data read by the performance data reading means;

lyrics displaying means for displaying characters corresponding to the lyrics data read by the lyrics data reading means; and displaying means for providing a display corresponding to the atmosphere data generated by the atmosphere data generating means.

* * * * *